US009290011B1

(12) United States Patent
Hojo et al.

(10) Patent No.: US 9,290,011 B1
(45) Date of Patent: Mar. 22, 2016

(54) PRINTER

(71) Applicant: Brother Kogyo Kabushiki Kaisha, Nagoya-shi, Aichi-ken (JP)

(72) Inventors: Kazuma Hojo, Inazawa (JP); Shinji Kobayashi, Tokoname (JP); Masashi Tanizaki, Kuwana (JP); Masashi Iwamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/840,170

(22) Filed: Aug. 31, 2015

(30) Foreign Application Priority Data

Oct. 15, 2014 (JP) ..... 2014-211108

(51) Int. Cl.
*B41J 32/00* (2006.01)
*B41J 3/407* (2006.01)

(52) U.S. Cl.
CPC ..... *B41J 3/4075* (2013.01); *B41J 32/00* (2013.01)

(58) Field of Classification Search
CPC ..... B41J 3/4075; B41J 3/36; B41J 32/00; B41J 35/36
See application file for complete search history.

(56) References Cited

U.S. PATENT DOCUMENTS 8,556,526 B2 * 10/2013 Noda ..... B41J 3/4075 400/207

FOREIGN PATENT DOCUMENTS

JP 2013-111756 A 6/2013

* cited by examiner

*Primary Examiner* — Sarah Al Hashimi
(74) *Attorney, Agent, or Firm* — Banner & Witcoff, Ltd.

(57) ABSTRACT

A printer includes a cassette mounting portion, a feed portion, a print head, a mechanical sensor, and a sensor holding portion. The cassette mounting portion is configured such that a tape cassette can be removably mounted therein. The tape cassette includes a tape and an indicator portion indicating a type of the tape. The feed portion is configured to feed, along a specified feed path, the tape contained in the tape cassette mounted in the cassette mounting portion. The print head is configured to perform printing on the tape fed by the feed portion. The mechanical sensor is configured to detect the type of the tape indicated by the indicator portion. The mechanical sensor includes a plurality of switch terminals and a switch holding portion. The sensor holding portion is configured to hold the mechanical sensor and to be moved between a first position and a second position.

7 Claims, 16 Drawing Sheets

PRINTER

CROSS-REFERENCE TO RELATED APPLICATION

This application claims priority to Japanese Patent Application No. 2014-211108 filed Oct. 15, 2014, the content of which is hereby incorporated herein by reference.

BACKGROUND

The present disclosure relates to a printer that is configured such that a tape cassette can be removably mounted therein and that is configured to perform printing on a tape contained in the tape cassette.

A printer is known that is configured to perform printing on a tape contained in a tape cassette. For example, a known printer can detect, using a plurality of mechanical sensors, a tape type (a tape width and a print format, for example) of a tape cassette mounted in a cassette mounting portion. The plurality of mechanical sensors are assembled to a side sensor main body portion. The side sensor main body portion is substantially box-shaped and can be moved in accordance with opening and closing of a cover of the printer.

SUMMARY

In the above-described printer, when an operator assembles the mechanical sensors to the side sensor main body portion, there is a case in which displacement of the mechanical sensors with respect to the side sensor main body portion occurs. In this case, it is possible that the mechanical sensors, the side sensor main body portion, or components attached to the mechanical sensors and the side sensor main body portion may be damaged or broken.

Embodiments of the broad principles derived herein provide a printer that allows an operator to more appropriately assemble a mechanical sensor to a side sensor main body portion.

Embodiments provide a printer that includes a cassette mounting portion, a feed portion, a print head, a mechanical sensor, and a sensor holding portion. The cassette mounting portion is configured such that a tape cassette can be removably mounted therein. The tape cassette includes a tape and an indicator portion. The tape is a print medium. The indicator portion indicates a type of the tape. The feed portion is configured to feed, along a specified feed path, the tape contained in the tape cassette mounted in the cassette mounting portion. The print head is configured to perform printing on the tape fed by the feed portion. The mechanical sensor is configured to detect the type of the tape indicated by the indicator portion. The mechanical sensor includes a plurality of switch terminals and a switch holding portion. The plurality of switch terminals are configured to advance and retract in a specified direction. The switch holding portion is a member including a holding surface. The holding surface is a surface holding the plurality of switch terminals. The sensor holding portion is configured to hold the mechanical sensor. The sensor holding portion is configured to be moved between a first position and a second position. The first position is a position in which the mechanical sensor is in close proximity to the indicator portion of the mounted tape cassette. The second position is a position in which the mechanical sensor is separated from the indicator portion of the mounted tape cassette. The sensor holding portion includes a main body portion, a support portion, an opening, and a first regulating member. The main body portion includes a facing surface and a mounting surface. The facing surface is a surface configured to be opposed to the mounted tape cassette. The mounding surface is a surface on an opposite side to the facing surface. The mechanical sensor is configured to be mounted on the main body portion from a mounting surface side being a side of the mounting surface. The support portion is provided on the mounting surface side of the main body portion. The support portion is configured to be in contact with the holding surface of the mechanical sensor mounted on the main body portion and to support the switch holding portion. The opening is provided in the main body portion. The opening is configured to expose the plurality of switch terminals from the opening to a side of the facing surface in a state in which the switch holding portion is supported by the support portion. The first regulating member is a member protruding in a first direction from the mounting surface side of the main body portion. The first direction is a direction opposite to a second direction. The second direction is a direction in which the mechanical sensor is mounted on the main body portion. The first regulating member is configured to be in contact with a first contact portion in a state in which the holding surface and the support portion are separated from and opposed to each other and a distance between the holding surface and the support portion is less than a specified value. The first contact portion is a part of an end portion, of the switch holding portion, in a direction orthogonal to the second direction.

BRIEF DESCRIPTION OF THE DRAWINGS

Embodiments will be described below in detail with reference to the accompanying drawings in which.

DETAILED DESCRIPTION

An embodiment will be explained with reference to the drawings. An overview of a configuration of a printer 1 according to the present embodiment will be explained with reference to FIG. 1 to FIG. 6, FIG. 9, and FIG. 10. In the following explanation, the upper right side, the lower left side, the lower right side, the upper left side, the lower side, and the upper side of FIG. 1 respectively correspond to the front side, the rear side, the right side, the left side, the upper side, and the lower side of the printer 1. The upper left side, the lower right side, the upper right side, the lower left side, the lower side, and the upper side of FIG. 4 respectively correspond to the front side, the rear side, the right side, the left side, the upper side, and the lower side of a cover 5.

Figure 1:
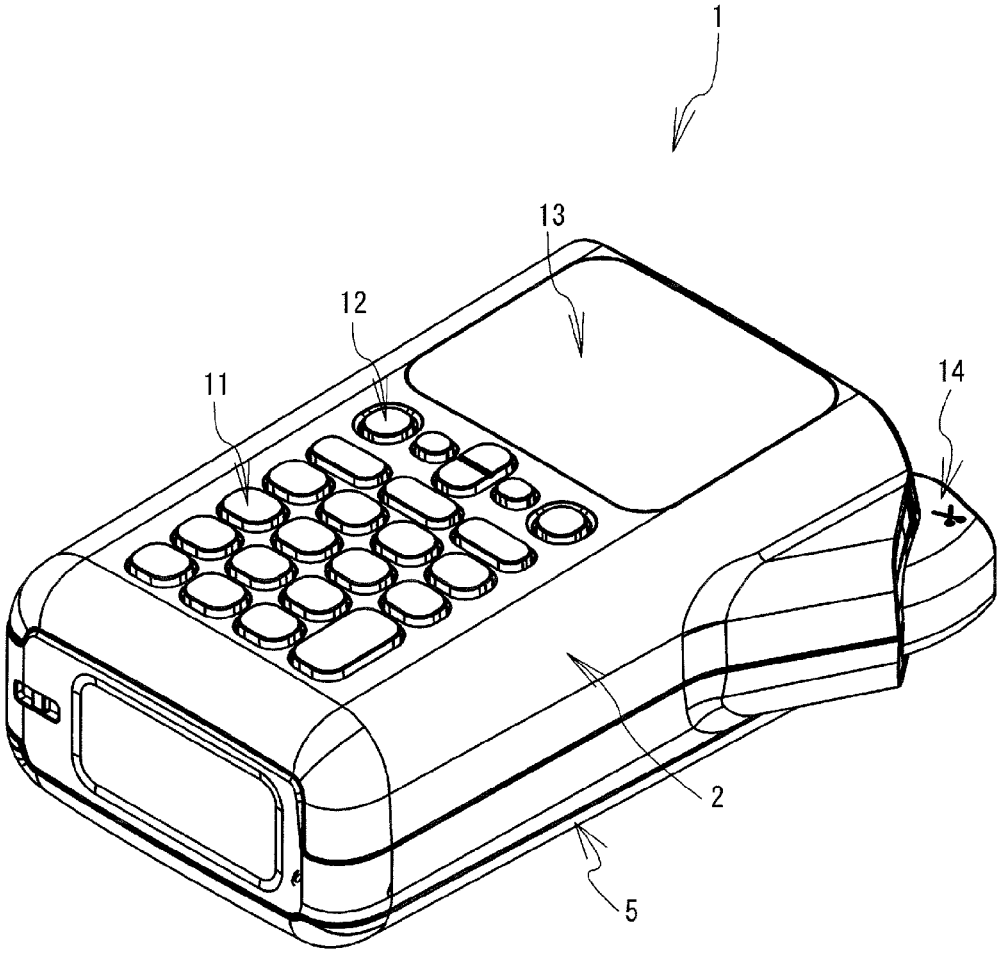
FIG. 1 is a perspective view of a printer as seen from below and the rear right.
Figure 2:
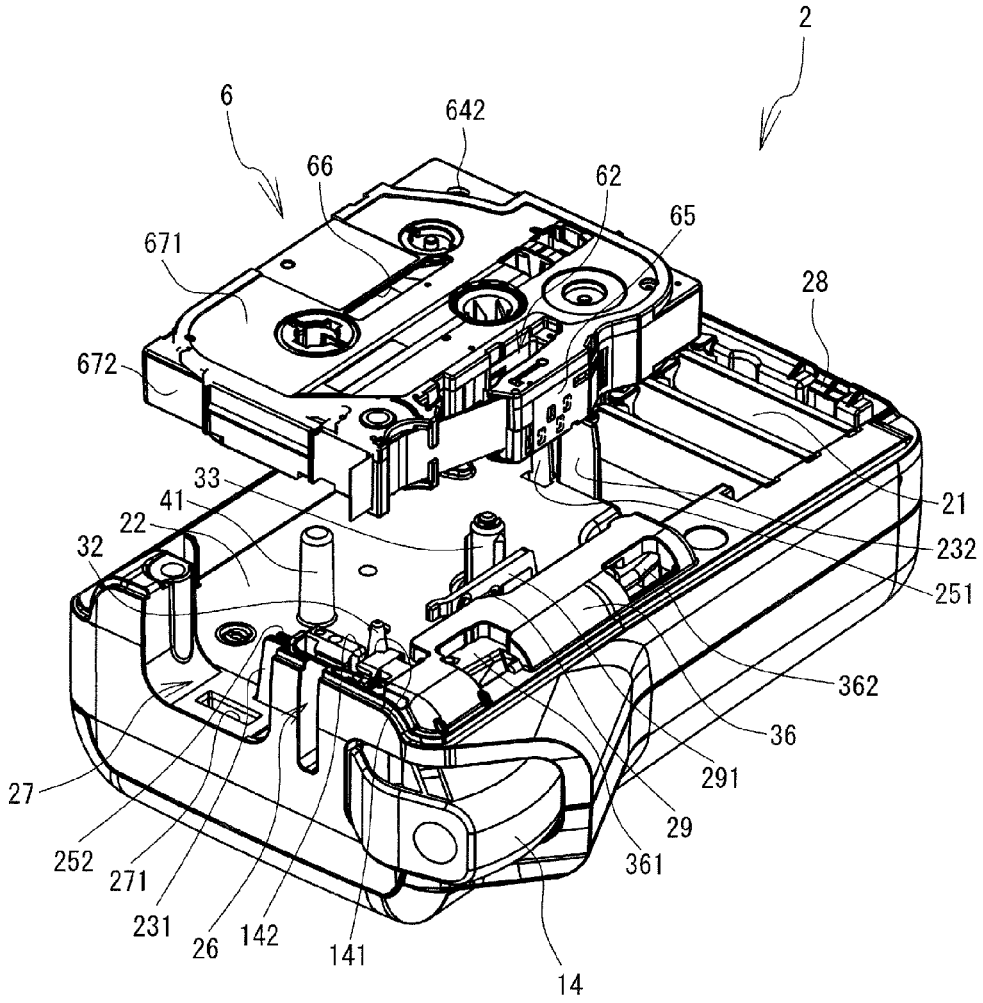
FIG. 2 is a perspective view of the printer when a cover is in an open state and a tape cassette, as seen from above and the front right.
Figure 3:
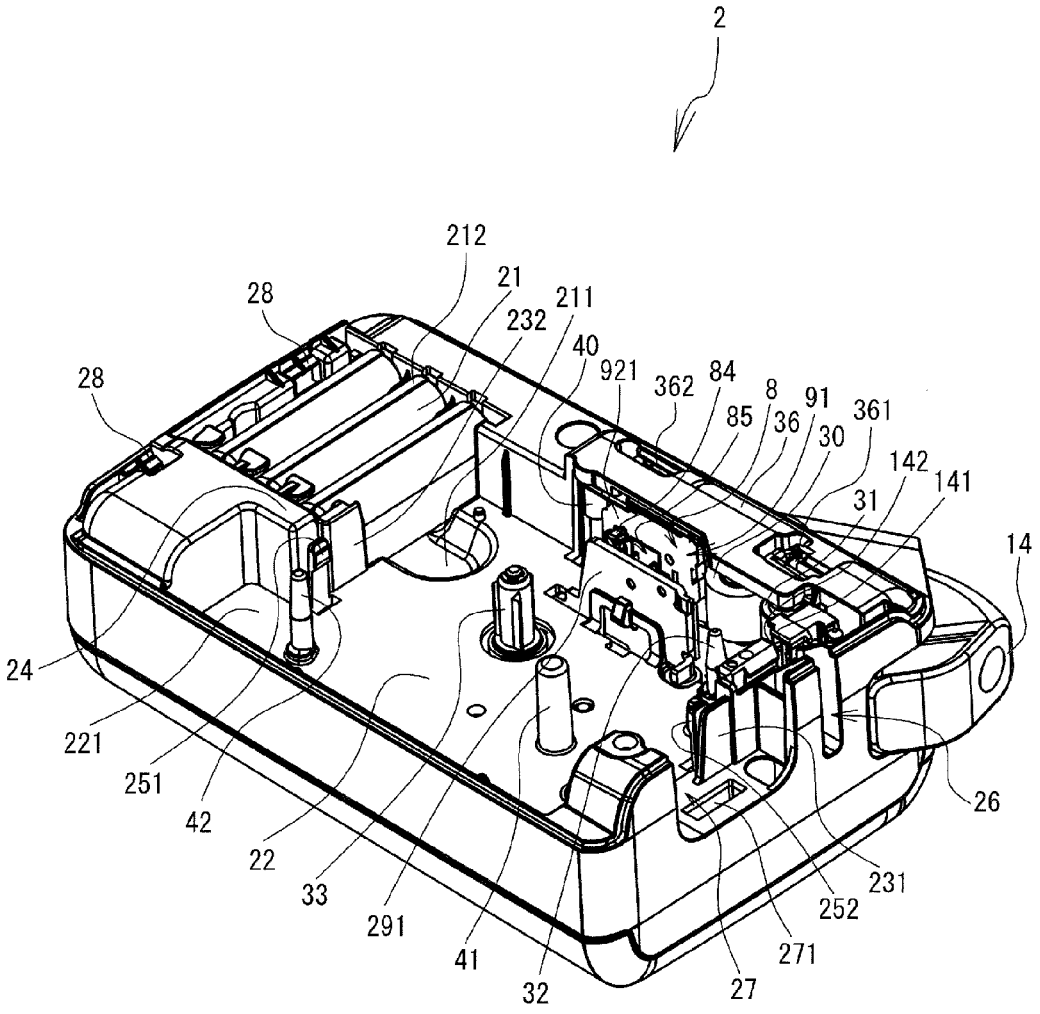
FIG. 3 is a perspective view of the printer when the cover is in the open state, as seen from above and the front left.

As shown in FIG. 1, the printer 1 is a substantially cuboid shape. The printer 1 includes a main housing 2 and the cover 5. The main housing 2 and the cover 5 are made of resin. A keyboard 11 is provided on a rear side portion of the lower surface of the main housing 2. The keyboard 11 is used to input a character and the like. A function key cluster 12, which includes a print key, is provided to the front of the keyboard 11. The function key cluster 12 is used to switch a power source on and off and to perform various controls of the printer 1. A liquid crystal display 13 is provided to the front of the function key cluster 12. The liquid crystal display 13 is configured to display a character, a symbol, and the like that have been input. The cover 5 is attached to the upper side of the main housing 2 such that the cover 5 can open and close.

Although not shown in the drawings, a control board, a power supply board, and the like are provided above the keyboard 11 and the function key cluster 12, namely, inside the main housing 2. The control board configures a control circuit portion. The power board configures a power supply circuit.

As shown in FIG. 2, FIG. 3, FIG. 5, and FIG. 6, a battery housing portion 21 is provided in a corner portion on the rear right side of the main housing 2. The battery housing portion 21 can removably house three batteries 212. A cassette housing portion 22 is provided adjacent to the battery housing portion 21, to the front of the battery housing portion 21. A tape cassette 6 can be inserted into and removed from above the cassette housing portion 22.

A rear waterproof wall 232, which protrudes upward, is provided on a front left end portion of the battery housing portion 21. A front waterproof wall 231, which protrudes upward, is provided substantially in the center of the cassette housing portion 22 in the left-right direction, in the vicinity of the front end of the cassette housing portion 22. A position of the left end of the front waterproof wall 231 in the left-right direction is further to the left than a position of the right end of the rear waterproof wall 232 in the left-right direction, and is further to the right than a position of the left end of the rear waterproof wall 232 in the left-right direction.

A battery finger hooking portion 211 is formed on the front side of the battery housing portion 21, substantially in the center of the battery housing portion 21 in the left-right direction. The battery finger hooking portion 211 is a portion that is recessed from the front end of the battery housing portion 21 toward the front. A user may insert and remove the frontmost battery 212 by placing the user's finger along the battery finger hooking portion 211. A cassette finger hooking portion 221 is formed in a rear left end portion of the cassette housing portion 22. The cassette finger hooking portion 221 is a portion that is recessed to the rear. The user may insert and remove the tape cassette 6 by placing the user's finger along the cassette finger hooking portion 221.

A wall portion 24, which extends upward, is provided between the battery housing portion 21 and the cassette finger hooking portion 221. A rear hook 251, which protrudes upward, is provided in the vicinity of the front side of the wall portion 24. The upper end portion of the rear hook 251 protrudes slightly to the front, and has a triangular shape in a side view. A front hook 252, which protrudes upward, is provided in the vicinity of the rear of the front waterproof wall 231. The upper end portion of the front hook 252 protrudes slightly to the rear and has a triangular shape in a side view. The wall portion 24 and the front waterproof wall 231 respectively inhibit the rear hook 251 and the front hook 252 from being damaged by outside pressure. When the tape cassette 6 is inserted into the cassette housing portion 22, the rear hook 251 and the front hook 252 may respectively engage with a pair of hook receiving portions 682 of the tape cassette 6.

A label discharge opening 26 is provided in the front side of the main housing 2. A knob 14 is provided on a corner portion to the right side of the label discharge opening 26. When the knob 14 is pushed inward, the knob 14 moves a movable blade 141, which is provided inside the label discharge opening 26, to the side of a fixed blade 142. In this manner, the fixed blade 142 and the movable blade 141 may cut a printed tape. The cut printed tape may be discharged from the label discharge opening 26.

Figure 4:
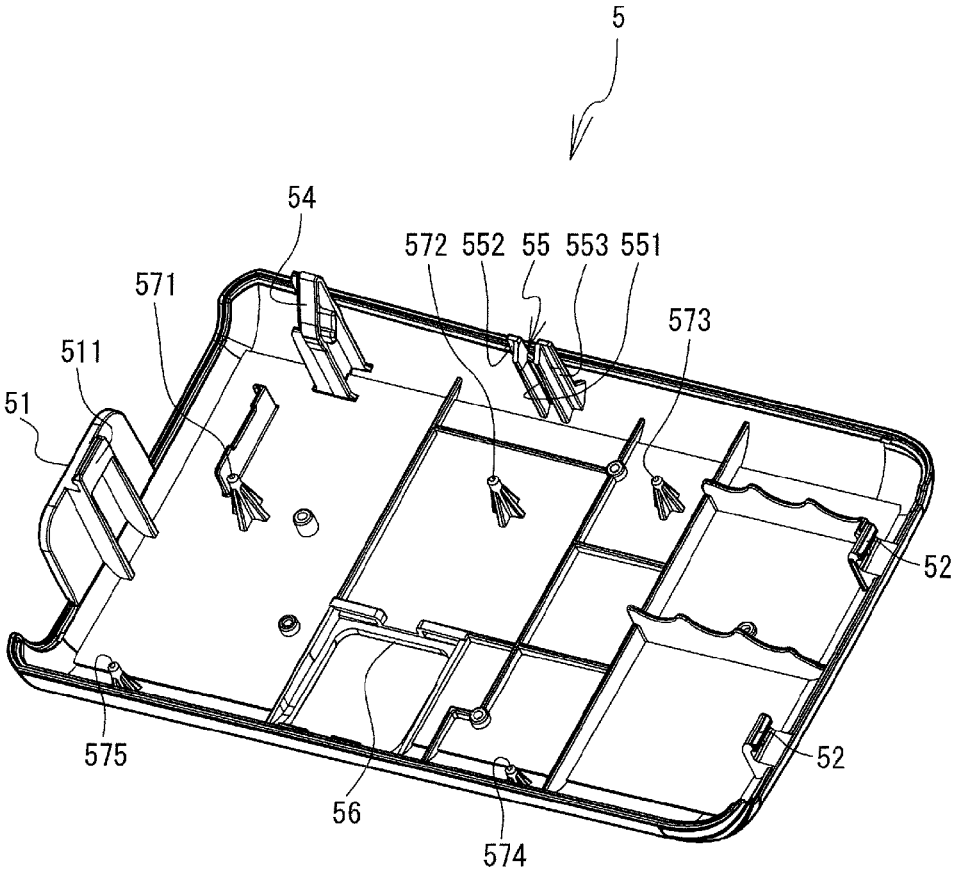
FIG. 4 is a perspective view of the cover, as seen from below and the rear left.

As shown in FIG. 4, a plate-shaped pressing portion 51 extends downward from a position further to the left side than a substantial center, in the left-right direction, of a front end edge portion of the cover 5. A recessed portion 27 (refer to FIG. 3) is formed in the front side of the main housing 2. When the cover 5 is closed, the pressing portion 51 covers a front surface side of the recessed portion 27. A locking piece 511 is provided in a center portion, in the left-right direction, of the lower end edge portion of the pressing portion 51. A locking protrusion that protrudes to the front is formed on the lower end of the locking piece 511. An engagement hole 271 (refer to FIG. 3) is formed in substantially the center of a bottom surface portion of the recessed portion 27. The locking piece 511 may engage with the engagement hole 271.

A pair of locking pieces 52 are respectively provided on the left and right sides of a rear end edge portion of the cover 5. A latching protrusion that protrudes to the rear is formed on each of the pair of locking pieces 52. A pair of engagement holes 28 (refer to FIG. 3) are respectively formed on the left and right sides of a rear end edge portion of the main housing 2. The pair of locking pieces 52 may engage with the pair of engagement holes 28.

When the user closes the cover 5, the pair of locking pieces 52 may respectively engage with the pair of engagement holes 28. Next, the user may use the pair of locking pieces 52 that are engaged with the pair of engagement holes 28, as a rotation axis, and may cause the cover 5 to rotate downward and to the front. Then, the user may cause the locking piece 511 to engage with the engagement hole 271 and may close the cover 5.

When opening the cover 5, the user may use the user's finger to press the pressing portion 51 of the cover 5 inward, may use the pair of locking pieces 52 that are engaged with the pair of engagement holes 28, as the rotation axis, and may cause the cover 5 to rotate upward and to the rear. In this way, the engagement between the locking piece 511 and the engagement hole 271 may be released and the cover 5 may be opened.

A roller holder cam 54, which protrudes downward, is provided in the vicinity of the right end edge of the cover 5 and to the front of the cover 5. The roller holder cam 54 is a substantially cuboid shape that is longer in the up-down direction, and a leading end portion of the roller holder cam 54 is substantially triangular in a front view. The roller holder cam 54 causes a platen holder 38 (refer to FIG. 5) to move in the left-right direction in accordance with the opening and closing operation of the cover 5.

A side sensor cam 55, which protrudes downward, is provided substantially in the center of the cover 5 in the front-rear direction, and to the rear of the roller holder cam 54. The side sensor cam 55 includes a plate member 551, a first protruding member 552, and a second protruding member 553. The plate member 551 is a substantially rectangular plate shape that is longer in the up-down direction. The first protruding member 552 extends downward from a front portion of the upper end of the plate member 551. The first protruding member 552 has an L shape in a plan view, and has a substantially rectangular shape with longer sides in the up-down direction in a front view and in a side view. The second protruding member 553 extends downward from a rear portion of the upper end of the plate member 551. The second protruding member 553 has an L shape that is symmetrical to the first protruding member 552 in a plan view, and has a substantially rectangular shape with longer sides in the up-down direction in a front view and in a side view. A length of the plate member 551 in the up-down direction is shorter than a length of the first protruding member 552 in the up-down direction. The length of the first protruding member 552 in the up-down direction is shorter than a length of the second protruding member 553 in the up-down direction. The side sensor cam 55 causes a side sensor main body portion 8 (refer to FIG. 8A) in the left-right direction in accordance with the opening and closing operation of the cover 5.

A substantially rectangular shaped peephole 56 is formed on the left side of the cover 5, substantially in the center of the cover 5 in the front-rear direction. When the tape cassette 6 is mounted in the cassette mounting portion 22, the peephole 56 faces a window portion 66 (refer to FIG. 11) of the tape cassette 6.

Pressing pins 571 to 575 are provided in a standing manner on the bottom surface of the cover 5. The pressing pins 571 to 575 are formed at a height such that, when the cover 5 is rotated downward and to the front and is thus closed, the pressing pins 571 to 575 come into contact with the top surface of the tape cassette 6 mounted in the cassette mounting portion 22.

Figure 5:
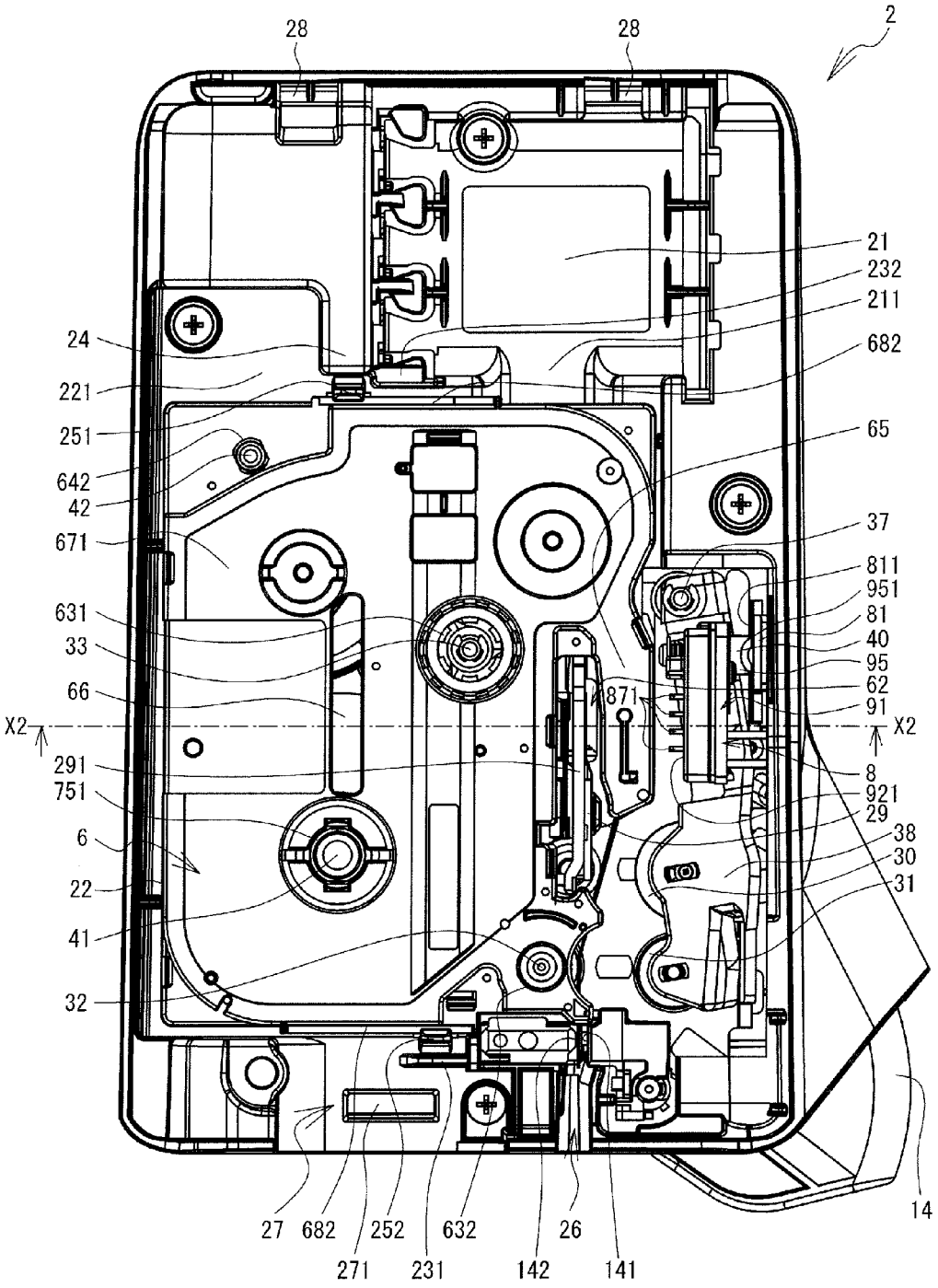
FIG. 5 is a plan view of the printer and the tape cassette, when a side sensor main body portion is in a contact position, with part of a protective portion and the cover being omitted from the view.
Figure 6:
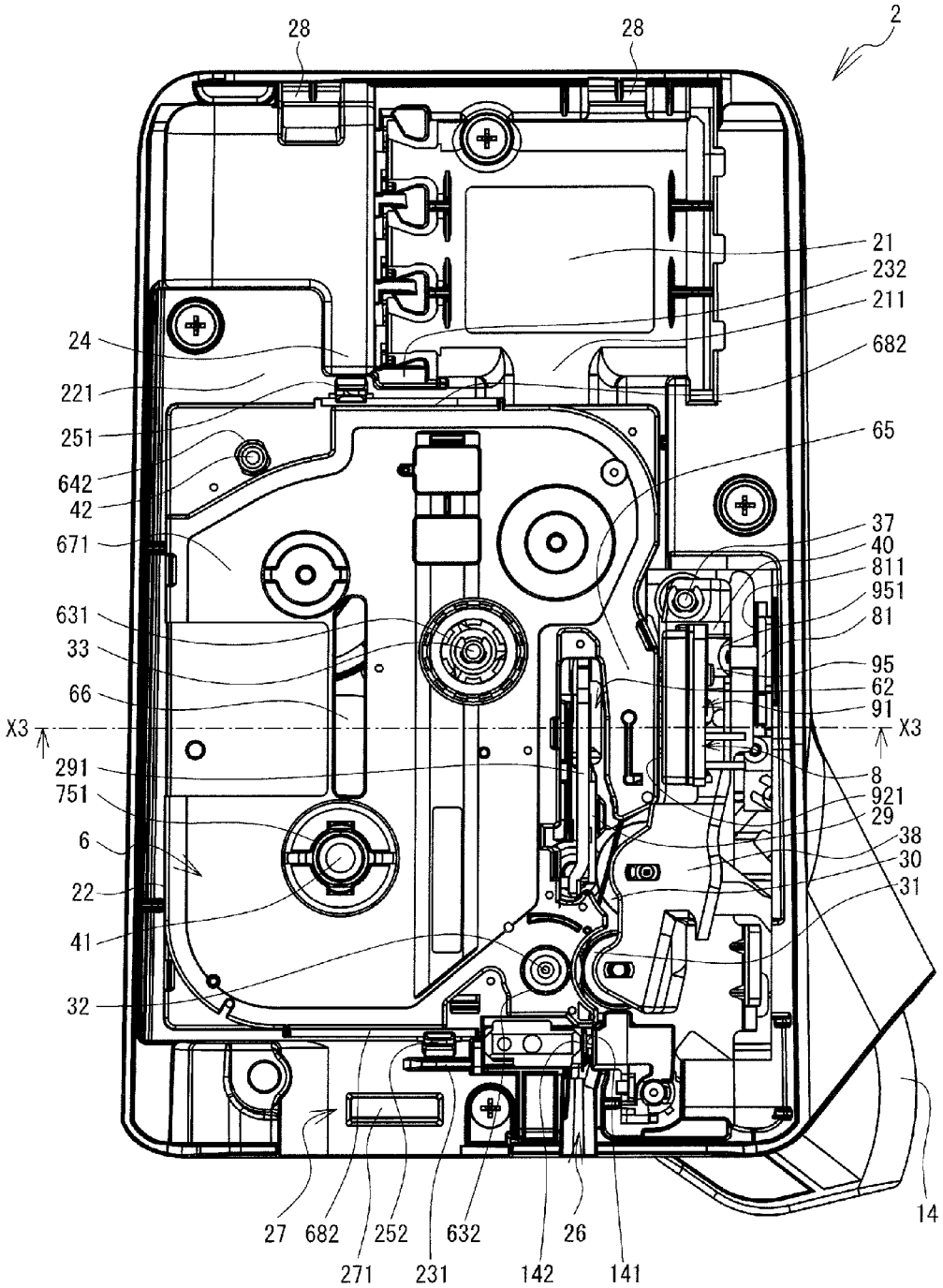
FIG. 6 is a plan view of the printer and the tape cassette, when the side sensor main body portion is in a separated position, with part of the protective portion and the cover being omitted from the view.

As shown in FIG. 5 and FIG. 6, a thermal head 29, a platen roller 30, a tape sub-roller 31, a tape drive roller shaft 32, a ribbon take-up shaft 33, and the like are placed in the cassette mounting portion 22. The platen roller 30 is provided to the right of the thermal head 29. The tape sub-roller 31 is provided in the vicinity of the front side of the platen roller 30. The tape drive roller shaft 32 is provided to the left of the tape sub-roller 31. The ribbon take-up shaft 33 is provided substantially in the center of the bottom surface of the cassette mounting portion 22.

The thermal head 29 has a flat plate shape that is substantially rectangular in a side view. The thermal head 29 is disposed on a right surface of a head holder 291, which is substantially rectangular in a side view. The head holder 291 is provided in the cassette mounting portion 22 such that the head holder 291 may be opposed to a feed direction of a print tape 612 (refer to FIG. 12) in a head insertion portion 62 of the tape cassette 6.

The tape cassette 6 includes a ribbon take-up spool 631 and a tape feed roller 632. The ribbon take-up shaft 33 is fitted into the ribbon take-up spool 631 and is driven to rotate. The tape drive roller shaft 32 is fitted into the tape feed roller 632 and is driven to rotate. The ribbon take-up shaft 33 and the tape drive roller shaft 32 are driven to rotate such that the print tape 612 and an ink ribbon 613 (refer to FIG. 12) are fed at the same feed speed.

As shown in FIG. 2, FIG. 3, FIG. 5, and FIG. 6, a protective portion 36 is provided on a right end portion of the main housing 2, further to the front side than the substantial center of the main housing 2 in the front-rear direction. The protective portion 36 opens to the left. A cam guide hole 361 and a cam guide hole 362 are respectively formed on portions of the protective portion 36 that correspond to the roller holder cam 54 and the side sensor cam 55 when the cover 5 is closed. Each of the cam guide hole 361 and the cam guide hole 362 is a through hole. The platen holder 38 is axially supported underneath the protective portion 36 such that the platen holder 38 can rotate around a rotating shaft 37. The platen roller 30 and the tape sub-roller 31 are axially supported by the platen holder 38 such that the platen roller 30 and the tape sub-roller 31 can rotate in the anti-clockwise direction in a plan view. A coil spring 39 (refer to FIG. 9) elastically urges the platen holder 38 to the right, centering on the rotating shaft 37. When the cover 5 is opened, the platen holder 38 is rotated toward a stand-by position shown in FIG. 3, by the coil spring 39.

As shown in FIG. 3, FIG. 5, FIG. 6, FIG. 9, and FIG. 10, a cavity 40, which is substantially rectangular in a side view, is formed between the platen roller 30 and the rotating shaft 37. The side sensor main body portion 8 and a receiving member 81 are provided in the cavity 40. A left side surface of the receiving member 81 is a receiving surface 811. A first shaft rod 821 and a second shaft rod 822, which extend toward the left, are provided on the receiving surface 811. The side sensor main body portion 8 is disposed such that the side sensor main body portion 8 can be moved in the left-right direction by the first shaft rod 821 and the second shaft rod 822.

The side sensor main body portion 8 will be explained in detail with reference to FIG. 7 and FIG. 8. In the following explanation, the lower right side, the upper left side, the upper right side, the lower left side, the upper side, and the lower side of FIG. 7A respectively correspond to the front side, the rear side, the right side, the left side, the upper side, and the lower side of the side sensor main body portion 8. The right side, the left side, a rear surface side, a front surface side, the upper side, and the lower side of FIG. 8A respectively correspond to a front side, a rear side, a right side, a left side, an upper side, and a lower side of the side sensor main body portion 8 and the receiving member 81 that are combined.

Figure 8A:
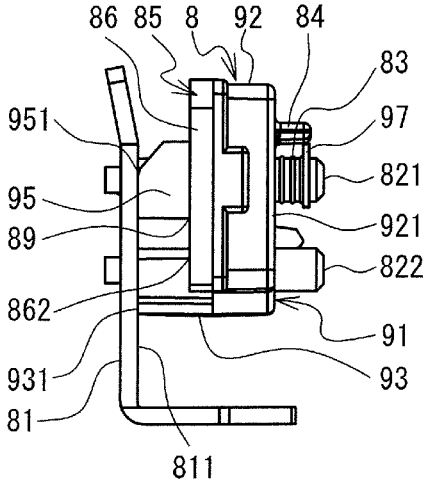
FIG. 8A is a side view of a receiving member and the side sensor main body portion in the contact position.

As shown in FIG. 8A, the side sensor main body portion 8 has a substantially cuboid shape. The side sensor main body portion 8 includes a mechanical sensor 85 and a sensor holding portion 91.

Figure 7A:
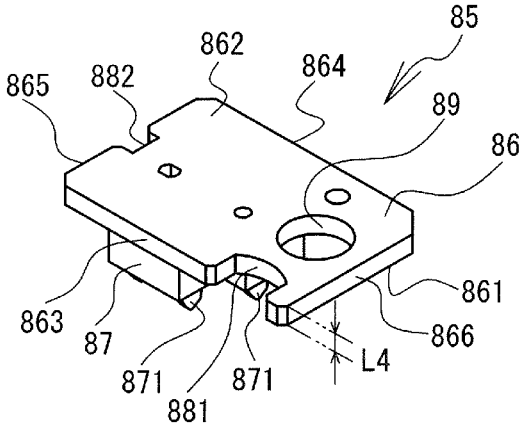
FIG. 7A is a perspective view of a mechanical sensor, as seen from above and the front left.

As shown in FIG. 7A, the mechanical sensor 85 includes a switch holding portion 86 and a base plate 87. The switch holding portion 86 has a substantially rectangular plate shape in a plan view. The switch holding portion 86 includes a holding surface 861 and an opposing surface 862. The holding surface 861 is a lower surface of the switch holding portion 86. The opposing surface 862 is an upper surface of the switch holding portion 86. A first contact portion 881 is a portion on the front side of a left end portion 863 of the switch holding portion 86. The first contact portion 881 is a recessed portion having a substantially rectangular shape with rounded corners in a plan view. A second contact portion 882 is a recessed portion having a substantially rectangular shape in a plan view at the center, in the left-right direction, of a rear end portion 865 of the switch holding portion 86. A hole 89 is formed at the front of the holding surface 861 and substantially in the center of the holding surface 861 in the left-right direction. The hole 89 passes through to the opposing surface 862. A right end portion 864 and a front end portion 866 of the switch holding portion 86 respectively form flat surfaces.

The base plate 87 is provided on the holding surface 861 of the switch holding portion 86. Four switch terminals 871, which protrude downward, are provided on the base plate 87. Each of the four switch terminals 871 has a flat plate shape that is substantially triangular in a front view. Each of the four switch terminals 871 can independently advance and retract from the base plate 87. The mechanical sensor 85 is configured to output an ON signal to a control circuit portion (not shown in the drawings) when the switch terminal 871 is pressed. The control circuit portion is configured to determine a type (a tape width etc., for example) of the print tape 612, based on the output signal input from the mechanical sensor 85.

Figure 7B:
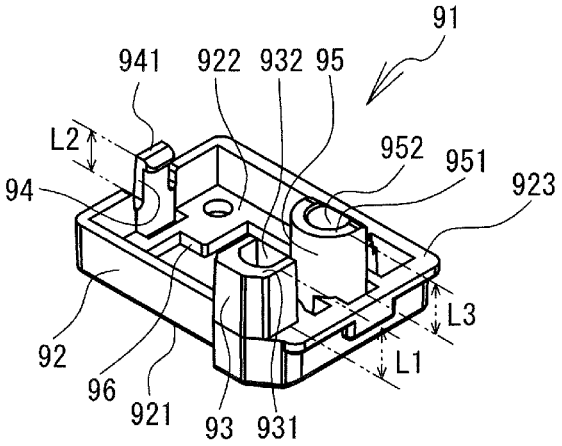
FIG. 7B is a perspective view of a sensor holding portion, as seen from above and the front left.

As shown in FIG. 7B, the sensor holding portion 91 mainly includes a main body portion 92, a first regulating member 93, a second regulating member 94, and a guide shaft 95. The main body portion 92 has a box shape that is open at the top. The main body portion 92 includes a facing surface 921 and a mounting surface 922. The facing surface 921 is a lower surface of the main body portion 92. The mounting surface 922 is an upper surface of the main body portion 92. An opening 96 is formed in substantially the center of the facing surface 921. The opening 96 has a substantially rectangular shape and passes through to the mounting surface 922. As shown in FIG. 8A, a positioning piece 84 is protrudingly provided above a first through portion 952 (to be described below), which is formed in the facing surface 921.

The first regulating member 93, which protrudes upward and has a U-shape in a plan view, is provided on the front side of the left end portion of the main body portion 92. The upper end portion of the first regulating member 93 is a first end portion 931. The first regulating member 93 has a second through portion 932, which passes through from the first end portion 931 to the facing surface 921. The second shaft rod 822 of the receiving member 81 is inserted into the second through portion 932. The second shaft rod 822 is in contact with the second through portion 932 from the first end portion 931 to the facing surface 921.

The second regulating member 94, which protrudes upward and has a plate shape, is provided in the center, in the left-right direction, of the rear end portion of the main body portion 92. The upper end portion of the second regulating member 94 is a second end portion 941. A locking piece that protrudes to the front is provided on the second end portion 941.

The guide shaft 95, which protrudes upward and has a cylindrical shape, is provided on the front side of the main body portion 92 and substantially in the center of the main body portion 92 in the left-right direction. The upper end portion of the guide shaft 95 is a third end portion 951. An inclined surface that inclines downward and to the right from substantially the center of the third end portion 951 in the left-right direction is formed on the third end portion 951. As shown in FIG. 8C, the guide shaft 95 has the first through portion 952, which passes through from the third end portion 951 to the facing surface 921. A diameter of the first through portion 952 of the facing surface 921 is larger than a diameter of the first through portion 952 of the third end portion 951. The first shaft rod 821 of the receiving member 81 is inserted into the first through portion 952. The first shaft rod 821 is in contact with the first through portion 952 at a section on the left side from substantially the center of the first through portion 952 in the front-rear direction.

As shown in FIG. 7B, the upper end portion of the main body portion 92 is a support portion 923. As shown in FIG. 7A and FIG. 7B, a distance from the support portion 923 to the first end portion 931 of the first regulating member 93 is denoted as a first distance L1. A distance from the support portion 923 to the second end portion 941 of the second regulating member 94 is denoted as a second distance L2. A distance from the support portion 923 to the third end portion 951 of the guide shaft 95 is denoted as a third distance L3. A length in the up-down direction of the switch holding portion 86 is denoted as a fourth distance L4. In this case, a relationship $L3 \geq L1 > L2 + L4$ is obtained. In the present embodiment, the first distance L1 is equal to the third distance L3.

Figure 7C:
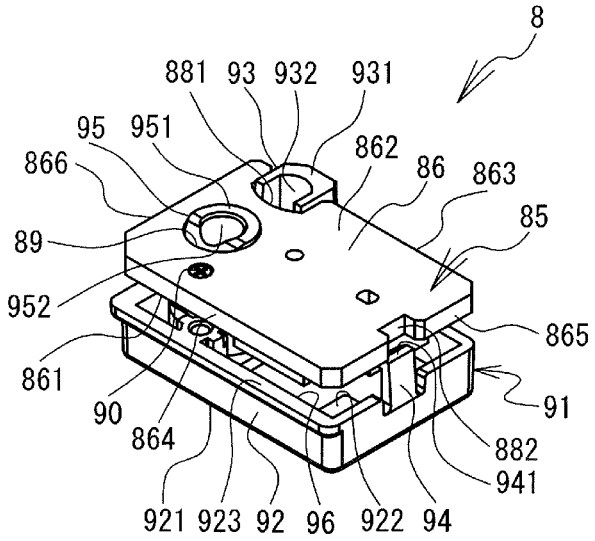
FIG. 7C is a perspective view of the mechanical sensor and the sensor holding portion in a non-engaged state, as seen from above and the rear right.

As shown in FIG. 7C, the mechanical sensor 85 and the sensor holding portion 91 are assembled such that the holding surface 861 of the mechanical sensor 85 is opposed to the mounting surface 922 of the sensor holding portion 91. When the mechanical sensor 85 and the sensor holding portion 91 are assembled, the guide shaft 95 and the first regulating member 93 are respectively inserted into the hole 89 and the first contact portion 881. Next, the holding surface 861 of the mechanical sensor 85 approaches the support portion 923 of the sensor holding portion 91 along the guide shaft 95. Next, the second regulating member 94 comes into contact with the second contact portion 882, and the locking piece of the second regulating member 94 is engaged with the opposing surface 862 of the mechanical sensor 85. Then, the mechanical sensor 85 and the sensor holding portion 91 are fixed by a screw 90.

Hereinafter, a state in which the first regulating member 93 is in contact with the first contact portion 881 and the second regulating member 94 is not in contact with the second contact portion 882 is referred to as a non-engaged state. A state in which the first regulating member 93 and the second regulating member 94 are respectively in contact with the first contact portion 881 and the second contact portion 882 is referred to as an engaged state. As described above, in the engaged state, the four switching terminals 871 of the mechanical sensor 85 protrude downward from the opening 96. In the engaged state, the first regulating member 93 and the guide shaft 95 respectively protrude from the first contact portion 881 and the hole 89 to the side of the opposing surface 862 of the switch holding portion 86.

Figure 8B:
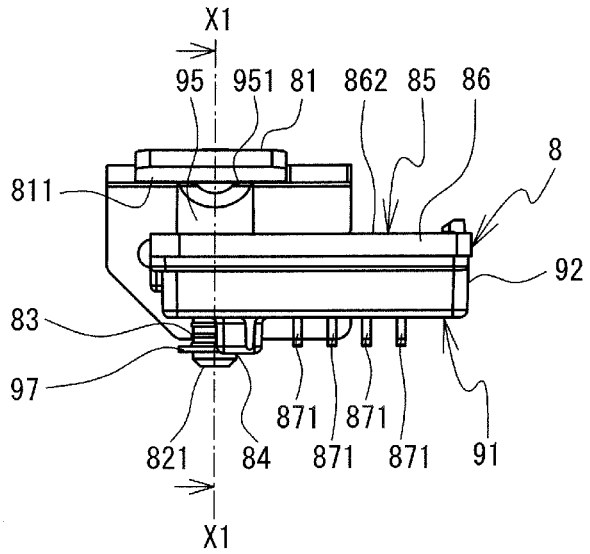
FIG. 8B is a plan view of FIG. 8A.
Figure 8C:
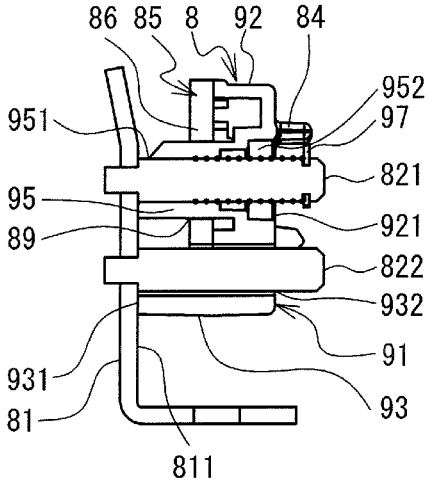
FIG. 8C is a cross-sectional view as seen in the direction of arrows along a line X1-X1 shown in FIG. 8B.

As shown in FIG. 8A to FIG. 8C, the first shaft rod 821 and the second shaft rod 822 are respectively inserted into the first through portion 952 and the second through portion 932 of the side sensor main body portion 8 from the side of the facing surface 921 of the sensor holding portion 91. The side sensor main body portion 8 can move in the front-rear direction with respect to the receiving member 81 along the first shaft rod 821 and the second shaft rod 822.

Hereinafter, as shown in FIG. 3, FIG. 5, FIG. 8A to FIG. 8C, and FIG. 9, a position in which each of the first end portion 931 of the first regulating member 93 and the third end portion 951 of the guide shaft 95 is in contact with the receiving surface 811 of the receiving member 81 is referred to as a contact position. As shown in FIG. 6 and FIG. 10, a position in which each of the first end portion 931 and the third end portion 951 is separated from the receiving surface 811 is referred to as a separation position.

Figure 9:
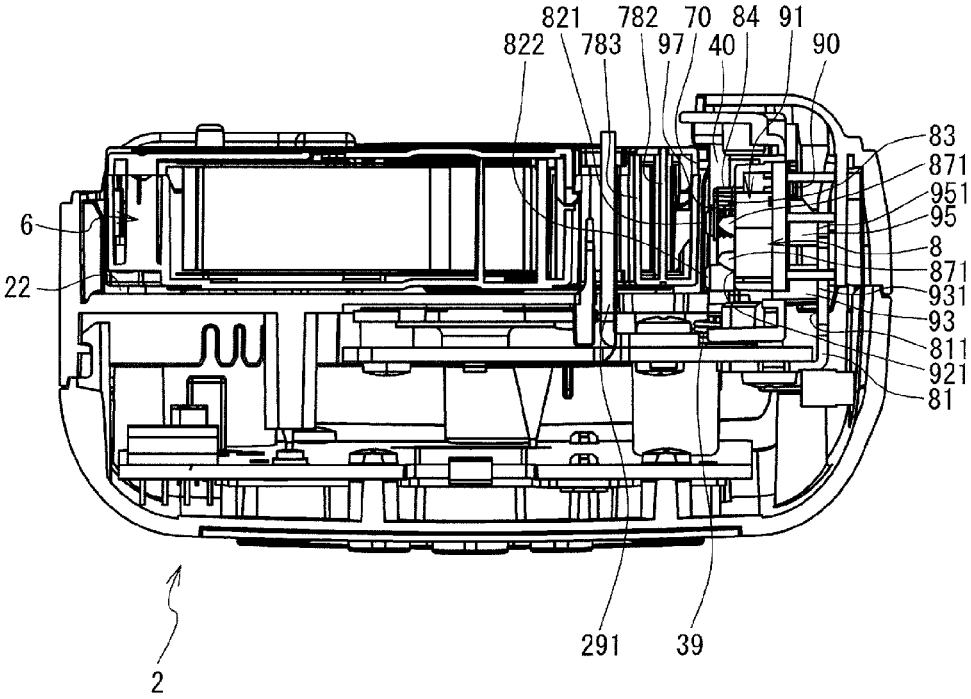
FIG. 9 is a cross-sectional view as seen in the direction of arrows along a line X2-X2 shown in FIG. 5.
Figure 10:
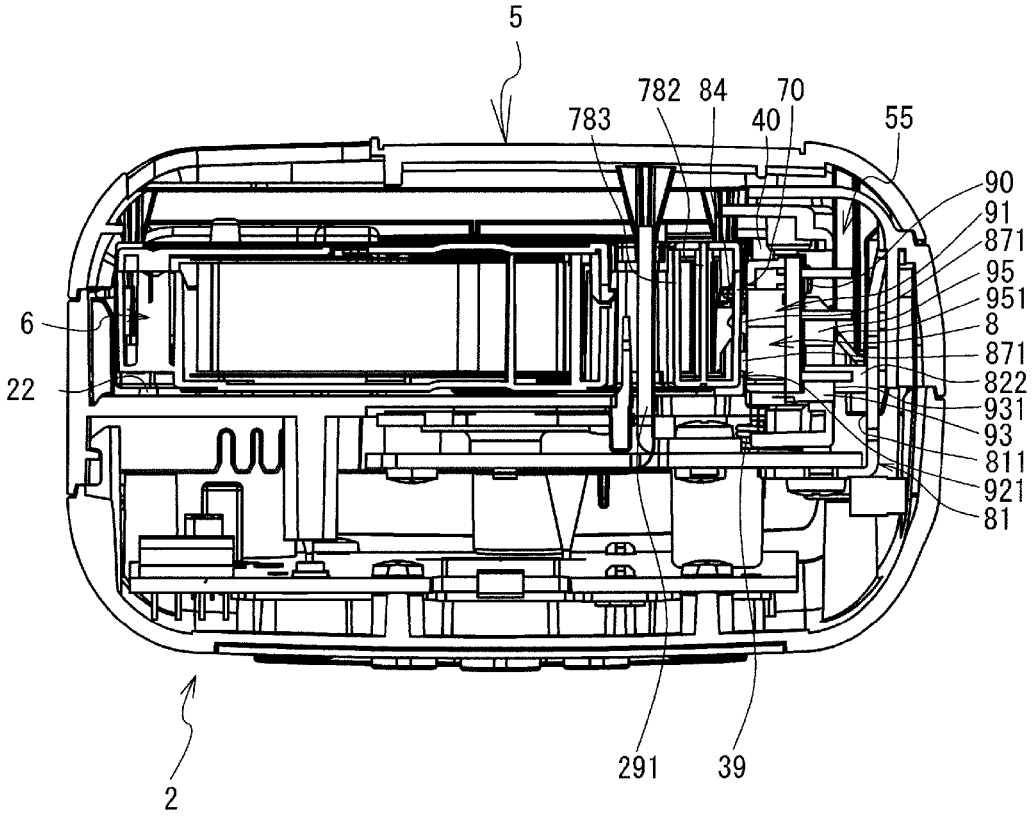
FIG. 10 is a cross-sectional view as seen in the direction of arrows along a line X3-X3 shown in FIG. 6.

As shown in FIG. 8A, FIG. 8B, and FIG. 9, the side sensor main body portion 8 includes a compression coil spring 83 that is positioned between a leading end portion of the first shaft rod 821 and the facing surface 921 of the sensor holding portion 91. The compression coil spring 83 is restricted from being displaced from the leading end of the first shaft rod 821 by a spring stopper 97. The side sensor main body portion 8 is urged in an outward direction (to the right in FIG. 5) by the compression coil spring 83. When the cover 5 is open, the side sensor main body portion 8 is moved toward the contact position, and is separated from the tape cassette 6 mounted in the cassette mounting portion 22.

As shown in FIG. 6 and FIG. 10, when the cover 5 is closed, the side sensor cam 55 is fitted into the cam guide hole 362. As described above, the cover 5 may be closed while rotating around the rear end portion side as the rotating axis. The length in the up-down direction of the second protruding member 553 of the side sensor cam 55 is longer than the length in the up-down direction of the first protruding member 552. Thus, the second protruding member 553 of the side sensor cam 55 comes into contact first with the inclined surface of the third end portion 951 of the guide shaft 95. Next, while the second protruding member 553 presses the side sensor main body portion 8 to the left, the first protruding member 552 also comes into contact with the inclined surface of the third end portion 951. In this manner, the side sensor main body portion 8 is pressed by the side sensor cam 55, resists the urging force of the compression coil spring 83 and is moved to the left, namely, is moved toward the separation position.

An outline configuration of the tape cassette 6 will be explained with reference to FIG. 11 and FIG. 12. In the following explanation, the lower right side, the upper left side, the upper right side, the lower left side, the upper side, and the lower side of FIG. 11 respectively correspond to the front side, the rear side, the right side, the left side, the upper side, and the lower side of the tape cassette 6.

Figure 11:
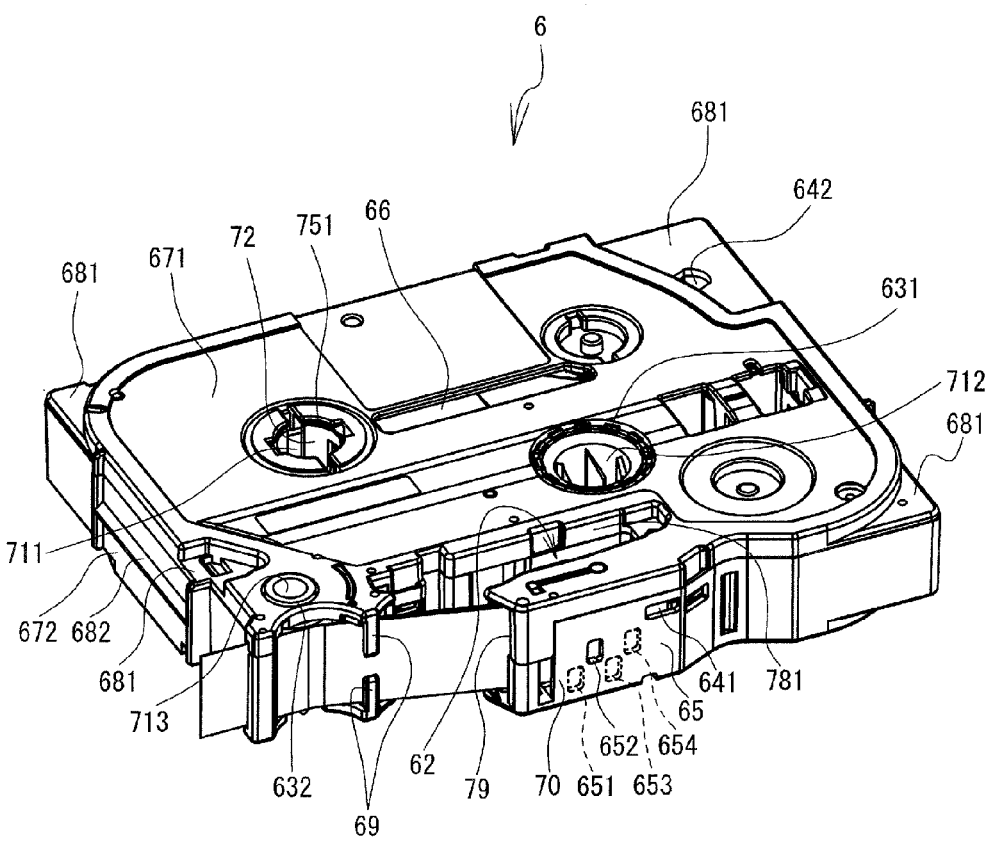
FIG. 11 is a perspective view of the tape cassette, as seen from above and the front left.
Figure 12:
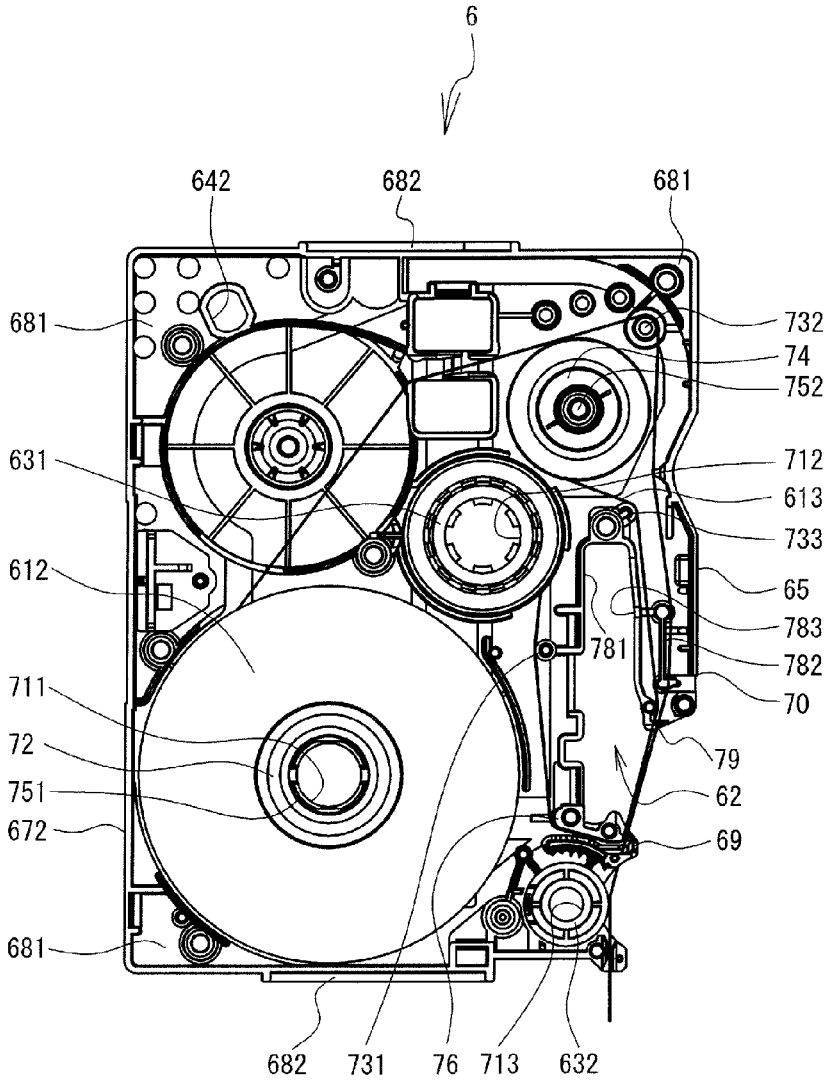
FIG. 12 is a plan view of the tape cassette when an upper case is removed.

As shown in FIG. 11 and FIG. 12, the tape cassette 6 has a box shape that is substantially rectangular in a plan view. The tape cassette 6 includes an upper case 671 and a lower case 672. Corner portions 681 are provided in the four corners of the upper case 671 of the tape cassette 6. The hook receiving portions 682 are provided on the left and right side surfaces of the tape cassette 6. Each of the corner portions 681 and the hook receiving portions 682 is formed in the same shape, irrespective of the type of the print tape 612 of the tape cassette 6. Specifically, irrespective of the type of the print tape 612 of the tape cassette 6, each of the corner portions 681 and the hook receiving portions 682 has the respective same lengths in the up-down direction, the front-rear direction, and the left-right direction, and has the same positional relationship. The corner portions 681 protrude in the outward direction such that the corner portions 681 each form a substantial right angle in a plan view. However, the lower left corner portion 681 does not form a right angle. Thus, when the tape cassette 6 is mounted in the cassette mounting portion 22, it is possible to inhibit interference between the lower left corner portion 681 and the label discharge opening 26. The hook receiving portions 682 protrude slightly in the outward direction from substantially the center, in the up-down direction, of the left and right side surfaces of the tape cassette 6.

A support hole 711, a support hole 712, and a support hole 713 are formed in the tape cassette 6. The support hole 711 rotatably supports a tape spool 72. The print tape 612 is wound on the tape spool 72. The support hole 712 supports the ribbon take-up spool 631. The ribbon take-up spool 631 may take up the ink ribbon 613 from a ribbon spool 74. A cassette boss 751 and a reel boss 752 are provided standing from the lower surface of the lower case 672. The tape spool 72 and the ribbon spool 74 are fitted by inserting the cassette boss 751 and the reel boss 752 respectively therein, such that the tape spool 72 and the ribbon spool 74 can rotate. The support hole 713 rotatably supports the tape feed roller 632. The print tape 612 may be pulled out from the tape spool 72 by the tape feed roller 632 and the tape sub-roller 31.

An arm portion 65, which protrudes in an arm shape, is provided on a front surface portion of the tape cassette 6. The head insertion portion 62 is formed in a U-shape in a plan view, by the arm portion 65 and a side wall portion 781, which is opposed to the arm portion 65. The head holder 291 may be inserted into the head insertion portion 62.

A wall portion on the front side of the arm portion 65 is a front surface wall portion 70. A positioning hole 641 is formed in a top right end portion of the front surface wall portion 70. As described above, the positioning piece 84 is provided in the sensor holding portion 91. When the tape cassette 6 is mounted in the cassette mounting portion 22 and the cover 5 is closed, the positioning piece 84 fits into the positioning hole 641. Four indicating portions 651 to 654 are provided in the front surface wall portion 70.

In order to determine the type of the print tape 612, a specific indicator portion of the indicator portions 651 to 654 is a through hole portion in accordance with a specific layout pattern that corresponds to the type of the print tape 612. For example, in the tape cassette 6 shown in FIG. 11, of the indicator portions 651 to 654, the indicator portion 652 is a through hole portion, while surface portions are formed in the indicator portions 651, 653, and 654.

A top and bottom pair of guide members 69 are provided in the vicinity of the front side of the tape feed roller 632. As shown in FIG. 12, a ribbon separating portion 76 is provided in the vicinity of the rear side of the guide members 69. A wall portion of the arm portion 65 on the head insertion portion 62 side (the rear side) is a rear surface wall portion 783. A thin plate-shaped separation wall 782 is provided in a central portion between the front surface wall portion 70 and the rear surface wall portion 783 of the arm portion 65. An arm opening 79 is formed in the vicinity of the left side of the separation wall 782.

As shown in FIG. 11, the substantially square-shaped window portion 66 is formed substantially in the center of the upper case 671. When the cover 5 is closed, the user may visually check the window portion 66 of the tape cassette 6 via the peephole 56 of the cover 5. In this way, the user may check a remaining amount of the print tape 612.

A flow in which the tape cassette 6 of the above-described configuration is mounted in the cassette mounting portion 22 will be explained with reference to FIG. 2, FIG. 3, FIG. 5, FIG. 11, and FIG. 12.

As shown in FIG. 2, FIG. 3, FIG. 5, FIG. 11 and FIG. 12, the ribbon take-up shaft 33 and the tape drive roller shaft 32 may be respectively fitted by insertion into the ribbon take-up spool 631 and the tape feed roller 632 of the tape cassette 6, and the head holder 291 may be inserted into the head insertion portion 62.

A positioning pin 42 and a positioning boss 41 are provided in a standing manner on a bottom surface portion of the cassette mounting portion 22. A positioning hole 642 is formed in the tape cassette 6. The positioning pin 42 may be inserted into the positioning hole 642. The positioning boss 41 may be inserted into the cassette boss 51. In this manner, the tape cassette 6 may be pushed downward into the cassette mounting portion 22 in a state in which the position of the tape cassette 6 in the front-rear direction and in the left-right direction is determined. Next, the rear hook 251 and the front hook 252 may engage with the pair of hook receiving portions 682 of the tape cassette 6. In this way, the tape cassette 6 may be mounted in the cassette mounting portion 22.

A state in which the cover 5 is closed after the tape cassette 6 is mounted in the cassette mounting portion 22 will be explained with reference to FIG. 6 and FIG. 10. When the cover 5 is closed, each of the pressing pins 571 to 575 provided on the cover 5 may be in contact with the upper surface of the tape cassette 6 mounted in the cassette mounting portion 22. The tape cassette 6 may be pressed to the bottom surface side of the cassette mounting portion 22. In this way, the position of the tape cassette 6 in the up-down direction may be determined.

As shown in FIG. 6 and FIG. 10, when the cover 5 is closed, the side sensor cam 55 may be inserted into the cam guide hole 362. The side sensor cam 55 may press the side sensor main body portion 8 to the left. In the present embodiment, the switch terminals 871 that are opposed to the indicator portions 651, 653, and 654 may be pressed. The switch terminal 871 that is opposed to the indicator portion 653 may pass through the indicator portion 653. The positioning piece 84 of the side sensor main body portion 8 may be inserted into the positioning hole 641 formed in the arm portion 65 of the tape cassette 6. As described above, the control circuit portion that is not shown in the drawings can determine the type of the print tape 612 based on the output signal input from the mechanical sensor 85.

When the cover 5 is closed, the roller holder cam 54 may be inserted into the cam guide hole 361. The roller holder cam 54 may press the platen holder 38 to the left. The platen holder 38 may resist the urging force of the coil spring 39 and may be moved to the left, namely, may be rotated toward a print position shown in FIG. 6.

Feeding of the print tape 612 and the ink ribbon 613 when the tape cassette 6 is mounted in the cassette mounting portion 22 and the cover 5 is closed will be explained with reference to FIG. 6 and FIG. 12.

As shown in FIG. 12, the print tape 612 may pass from the tape spool 72 past a guide pin 732 and may be fed between the front surface wall portion 705 and the separation wall 782 of the arm portion 6. The ink ribbon 613 may pass from the ribbon spool 74 past a guide pin 733 and may be fed between the rear surface wall portion 783 and the separation wall 782 of the arm portion 65. Next, the ink ribbon 613 and the print tape 612 may be overlapped with each other and may be fed to the head insertion portion 62 from the arm opening 79.

Next, as shown in FIG. 6, the print tape 612 and the ink ribbon 613 may be pressed against the thermal head 29 by the platen roller 30. The thermal head 29 may generate heat, may heat the ink ribbon 613 from the left, may perform heat transfer of the ink onto the print tape 612, and thus the print data of a character etc. may be printed.

Next, as shown in FIG. 12, the ink ribbon 613 may be separated from the print tape 612 by the ribbon separating portion 76. The separated ink ribbon 613 may pass a guide pin 731 and may be taken up by the ribbon take-up spool 631. The ink ribbon 613 and the printed tape that have been separated by the ribbon separating portion 76 may be fed to the tape feed roller 632 while being regulated in the up-down direction by the guide members 69. The tape feed roller 632 may be driven to rotate by the tape drive roller shaft 32. The printed tape may be pressed against the tape feed roller 632 by the tape sub-roller 31. The printed tape may be discharged from the label discharge opening 26 by the rotation of the tape feed roller 632.

As described above, in the printer 1 of the present embodiment, the sensor holding portion 91 includes the first regulating member 93. By this, the mechanical sensor 85 may be mounted on the sensor holding portion 91 while the first regulating member 93 of the sensor holding portion 91 is in contact with the first contact portion 881 of the mechanical sensor 85. In this way, taking the direction in which the mechanical sensor 85 is mounted on the sensor holding portion 91 as an axis, it is possible to regulate rotation of the mechanical sensor 85 with respect to the sensor holding portion 91. As a result, an operator may more appropriately assemble the mechanical sensor 85 with respect to the sensor holding portion 91.

In the printer 1 of the present embodiment, the sensor holding portion 91 includes the second regulating member 94. Further, the first distance L1 of the first regulating member 93 is greater than the second distance L2 of the second regulating member 94. By this, when the mechanical sensor 85 is mounted on the sensor holding portion 91, in the non-engaged state, the first regulating member 93 may regulate the rotation of the mechanical sensor 85 with respect to the sensor holding portion 91, taking the direction in which the mechanical sensor 85 is mounted on the sensor holding portion 91 as the axis. Thus, the operator may more appropriately assemble the mechanical sensor 85 with respect to the sensor holding portion 91.

The printer 1 of the present embodiment includes the guide shaft 95, which has the first through portion 952, and the first regulating member 93, which has the second through portion 932. Further, the printer 1 includes the receiving member 81, which includes the first shaft rod 821 and the second shaft rod 822. The first shaft rod 821 is inserted into the first through portion 952. The second shaft rod 822 is inserted into the second through portion 932. The first distance L1 of the first regulating member 93 is equal to the third distance L3 of the guide shaft 95. In this way, in the contact position, the first end portion 931 of the first regulating member 93 and the third end portion 951 of the guide shaft 95 may come into contact with the receiving surface 811 of the receiving member 81 simultaneously and in a stable manner. Thus, a swing in a direction linking the first regulating member 93 and the guide shaft 95 may be reduced.

In the printer 1 of the present embodiment, the first regulating member 93, which has the second through portion 932, extends from the facing surface 921 of the sensor holding portion 91 as far as the first end portion 931. The diameter of the first through portion 952 of the facing surface 921 is larger than the diameter of the first through portion 952 of the third end portion 951. In this manner, a contact area between the second shaft rod 822 inserted into the second through portion 932 and the second through portion 932 is larger than a contact area between the first shaft rod 821 inserted into the first through portion 952 and the first through portion 952. Thus, the second shaft rod 822 may be held in a stable manner by the second through portion 932.

In the printer 1 of the present embodiment, the battery housing portion 21 is provided to the rear of the cassette mounting portion 22 in the main housing 2, in the vicinity of the right surface of the main housing 2. The rear hook 251 is provided in a position in which the rear hook 251 can be engaged with the hook receiving portion 682 of the tape cassette 6 mounted in the cassette housing portion 22, and in a position further to the left than the battery housing portion 21. Thus, it is possible to provide the battery finger hooking portion 211 in the position substantially in the center of the battery housing portion 21 in the left-right direction. As a result, it becomes easier for the user to apply pressure to the battery 212 when inserting or removing the battery 212, and the user may thus easily insert and remove the battery 212. Further, it is possible to provide the rear hook 251 in the vicinity of the cassette finger hooking portion 221. As a result, it becomes easier for the user to apply pressure to the tape cassette 6, and the user may thus easily insert and remove the tape cassette 6. Further, as the rear hook 251 is not present to the front of the battery housing portion 21, it is possible to make a length of the cassette finger hooking portion 221 longer in the left-right direction. As a result, it becomes easier for the user to hold the tape cassette 6 with the user's fingers, and the user may thus easily insert and remove the tape cassette 6. In addition, the wall portion 24 is provided between the battery housing portion 21 and the cassette finger hooking portion 221 and behind the rear hook 251, and the wall portion 24 may protect the rear hook 251. Thus, it is not necessary to separately provide a wall for protecting the rear hook 251, and it is possible to reduce the size of the printer 1.

In the printer 1 of the present embodiment, the front waterproof wall 231 and the rear waterproof wall 232 are provided. The position of the left end of the front waterproof wall 231 in the left-right direction is located further to the left than the position of the right end of the rear waterproof wall 232 in the left-right direction, and is located further to the right than the position of the left end of the rear waterproof wall 232 in the left-right direction. For example, it is assumed that the user uses the printer 1 with the pressing portion 51 facing upward. In this case, if fluid enters inside the main housing 2 from the pressing portion 51, the fluid may flow further to the left than the front waterproof wall 231. Then, the fluid may collide against the rear waterproof wall 232 and may flow to the left of the rear waterproof wall 232. It is thus possible to reduce the possibility that the fluid enters into the battery housing portion 21.

In the printer 1 of the present embodiment, the length in the up-down direction of the second protruding member 553 of the side sensor cam 55 is longer than the length in the up-down direction of the first protruding member 552. Further, the cover 5 may be closed by rotating the cover 5 downward and to the front around the rotating axis formed by the rear end portion of the cover 5 and the rear end portion of the main housing 2. In this way, of the side sensor cam 55, the second protruding member 553 may come into contact first with the inclined surface of the third end portion 951 of the guide shaft 95. Then, while the second protruding member 553 may press the side sensor main body portion 8 to the left, the first protruding member 552 of the side sensor cam 55 may come into contact with the inclined surface of the third end portion 951. In this case, sliding resistance may be reduced in comparison to a case in which two locations of the side sensor cam 55 come into contact with the inclined surface of the third end portion 951 of the guide shaft 95. Thus, the user may easily close the cover 5. When the second protruding member 553 comes into contact with the guide shaft 95, the side sensor main body portion 8 moves to the left. In this way, until the first protruding member 552 comes into contact with the inclined surface of the third end portion 951, the opposing surface 862 of the mechanical sensor 85 of the side sensor main body portion 8 and the side sensor cam 55 are separated from each other. It is therefore possible to provide a part, such as the screw 90, in a portion, of the opposing surface 862, that is opposed to the first protruding member 552.

Various modifications may be made to the above-described embodiment. For example, as shown in FIG. 8C, the first shaft rod 821, the second shaft rod 822, the first through portion 952, and the second through portion 932 need not necessarily be provided. In this case also, it is sufficient if the side sensor main body portion 8 is able to move between the contact position and the separation position. In this case, similarly to the above-described embodiment, in the contact position, the first end portion 931 of the first regulating member 93 and the third end portion 951 of the guide shaft 95 may come into contact with the receiving surface 811 of the receiving member 81 simultaneously and in a stable manner. Thus, the swing in the direction linking the first regulating member 93 and the guide shaft 95 may be reduced.

For example, as shown in FIG. 8C, the second through portion 932 need not necessarily be provided in the first regulating member 93 and may be provided in the sensor holding portion 91. In this case also, it is sufficient if the side sensor main body portion 8 is able to move between the contact position and the separation position. In this case, similarly to the above-described embodiment, in the contact position, the first end portion 931 of the first regulating member 93 and the third end portion 951 of the guide shaft 95 may come into contact with the receiving surface 811 of the receiving member 81 simultaneously and in a stable manner. Thus, the swing in the direction linking the first regulating member 93 and the guide shaft 95 may be reduced.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A printer comprising:

a cassette mounting portion configured such that a tape cassette can be removably mounted therein, the tape cassette including a tape and an indicator portion, the tape being a print medium, and the indicator portion indicating a type of the tape;

a feed portion configured to feed, along a specified feed path, the tape contained in the tape cassette mounted in the cassette mounting portion;

a print head configured to perform printing on the tape fed by the feed portion;

a mechanical sensor configured to detect the type of the tape indicated by the indicator portion, the mechanical sensor including a plurality of switch terminals and a switch holding portion, the plurality of switch terminals being configured to advance and retract in a specified direction, and the switch holding portion being a member including a holding surface, the holding surface being a surface holding the plurality of switch terminals; and a sensor holding portion configured to hold the mechanical sensor, the sensor holding portion being configured to be moved between a first position and a second position, the first position being a position in which the mechanical sensor is in close proximity to the indicator portion of the mounted tape cassette, the second position being a position in which the mechanical sensor is separated from the indicator portion of the mounted tape cassette, and the sensor holding portion including:

a main body portion that includes a facing surface and a mounting surface, the facing surface being a surface configured to be opposed to the mounted tape cassette, the mounting surface being a surface on an opposite side to the facing surface, and the mechanical sensor being configured to be mounted on the main body portion from a mounting surface side being a side of the mounting surface;

a support portion provided on the mounting surface side of the main body portion, the support portion being configured to be in contact with the holding surface of the mechanical sensor mounted on the main body portion and to support the switch holding portion;

an opening provided in the main body portion, the opening being configured to expose the plurality of switch terminals from the opening to a side of the facing surface in a state in which the switch holding portion is supported by the support portion; and a first regulating member being a member protruding in a first direction from the mounting surface side of the main body portion, the first direction being a direction opposite to a second direction, the second direction being a direction in which the mechanical sensor is mounted on the main body portion, the first regulating member being configured to be in contact with a first contact portion in a state in which the holding surface and the support portion are separated from and opposed to each other and a distance between the holding surface and the support portion is less than a specified value, and the first contact portion being a part of an end portion, of the switch holding portion, in a direction orthogonal to the second direction.

2. The printer according to claim 1, wherein the sensor holding portion further includes a second regulating member, the second regulating member being a member protruding in the first direction from the mounting surface side of the main body portion, the second regulating member being configured to be in contact with a second contact portion and to press an opposing surface in a state in which the holding surface and the support portion are in contact with each other, the second contact portion being a part of an end portion of the main body portion, the second contact portion being different from the first contact portion, and the opposing surface being a surface on an opposite side to the holding surface of the switch holding portion, and a first distance is larger than a second distance, the first distance being a distance in the second direction from a first end portion to the support portion, the first end portion being an end portion, in the first direction, of the first regulating member, the second distance being a distance in the second direction from a second end portion to the support portion, and the second end portion being an end portion, in the first direction, of the second regulating member.

3. The printer according to claim 2, further comprising:

a receiving member that includes a receiving surface, the receiving surface being a surface that is opposed to the mounting surface of the main body portion, wherein the switch holding portion includes a hole that passes through in the first direction from the holding surface to the opposing surface, the sensor holding portion includes a guide shaft, the guide shaft being a member protruding in the first direction from the mounting surface side of the main body portion, and the guide shaft being configured to be inserted into the hole, the sensor holding portion is configured to be moved between a contact position and a separation position, the contact position being a position in which the first end portion and a third end portion are in contact with the receiving surface of the receiving member, the third end portion being an end portion, in the first direction, of the guide shaft, and the separation position being a position in which the first end portion and the third end portion are separated from the receiving surface of the receiving member, the first distance is equal to a third distance, the third distance being a distance in the second direction from the third end portion of the guide shaft to the support portion, and the first regulating member is configured to be in contact with the first contact portion in a non-engaged state, the non-engaged state being a state in which the holding surface and the support portion are separated from each other and the guide shaft is inserted into the hole of the switch holding portion.

4. The printer according to claim 3, wherein the main body portion includes a first through portion and a second through portion, the first through portion passing through, in the first direction, from the facing surface to the third end portion of the guide shaft, the second through portion being provided in a position different from the first through portion in the main body portion, and the second through portion passing through, in the first direction, from the facing surface to the mounting surface side, the receiving member includes a first shaft rod and a second shaft rod, the first shaft rod being a shaft rod configured to be inserted into the first through portion, the first shaft rod extending from the receiving surface in the second direction, the second shaft rod being a shaft rod configured to be inserted into the second through portion, and the second shaft rod extending from the receiving surface in the second direction, and the sensor holding portion is configured to be moved between the contact position and the separation position along the first shaft rod and the second shaft rod.

5. The printer according to claim 4, wherein the second through portion passes through, in the first direction, as far as the first end portion of the first regulating member.

6. The printer according to claim 2, further comprising:

a receiving member that includes a receiving surface, the receiving surface being a surface that is opposed to the mounting surface of the sensor holding portion;

wherein the main body portion includes a first through portion and a second through portion, the first through portion passing through, in the second direction, from the mounting surface to the facing surface, the second through portion being provided in a position different from the first through portion in the main body portion, and the second through portion passing through, in the first direction, from the facing surface to the first end portion of the first regulating member, the receiving member includes a first shaft rod and a second shaft rod, the first shaft rod being a shaft rod configured to be inserted into the first through portion, the first shaft rod extending from the receiving surface in the first direction, the second shaft rod being a shaft rod configured to be inserted into the second through portion, and the second shaft rod extending from the receiving surface in the second direction, the sensor holding portion is configured to be moved between a contact position and a separation position along the first shaft rod and the second shaft rod, the contact position being a position in which the first end portion is in contact with the receiving surface, and the separation position being a position in which the first end portion is separated from the receiving surface, and the first regulating member is a wall portion that extends further than the support portion in the first direction, the first regulating member including a support wall portion that extends along the second shaft rod inserted into the second through portion.

7. The printer according to claim 6, wherein the support wall portion extends, in the first direction, from the facing surface to the first end portion of the first regulating member, and the second shaft rod is configured to be in contact with the support wall portion from the first end portion to the facing surface.

* * * * *